US005802635A

United States Patent [19]

Chen

[11] Patent Number: 5,802,635

[45] Date of Patent: Sep. 8, 1998

[54] FOLDABLE CRADLE

[76] Inventor: Jr Long Chen, No. 17, Lane 431, Lien Tsuen Road, Fong Yuan City, Taichung, Taiwan

[21] Appl. No.: 862,038

[22] Filed: May 22, 1997

[51] Int. Cl.[6] ..... A47D 9/00

[52] U.S. Cl. ..... 5/102; 5/127

[58] Field of Search ..... 5/101, 102, 127, 5/130, 103, 98.3

[56] References Cited

U.S. PATENT DOCUMENTS

| | | | |
|---|---|---|---|
| 235,809 | 12/1880 | Price | 5/130 |
| 1,217,519 | 2/1917 | Sisbower et al. | 5/130 |
| 1,431,408 | 10/1922 | Melniker et al. | 5/130 |
| 4,996,732 | 3/1991 | Chang | 5/101 |

FOREIGN PATENT DOCUMENTS

| | | | |
|---|---|---|---|
| 142964 | 5/1920 | United Kingdom | 5/101 |
| 444473 | 3/1936 | United Kingdom | 5/101 |

*Primary Examiner*—Michael F. Trettel

[57] ABSTRACT

A foldable cradle includes a pair of frames pivotally coupled together at a pivot shaft for allowing the frames to be rotated about the pivot shaft and to be rotated between an open position and a folded position. One of the frames includes a beam secured on top and two rods secured to the beam and perpendicular to the beam. A flexible support of soft weaving material is secured to the rods for comfortably supporting the baby and for allowing the parents to hold the baby without disturbing the baby when the baby fall asleep.

2 Claims, 2 Drawing Sheets

FOLDABLE CRADLE

BACKGROUND OF THE INVENTION

1. Field of the Invention

The present invention relates to a cradle, and more particularly to a foldable cradle.

2. Description of the Prior Art

Typical cradles comprise a fixed support that may not be folded such that the cradles are not good for storing and transportation purposes. In addition, the cradles comprise a parallelepiped support which may not be comfortably support the baby.

The present invention has arisen to mitigate and/or obviate the afore-described disadvantages of the conventional cradles.

SUMMARY OF THE INVENTION

The primary objective of the present invention is to provide a cradle which includes a foldable structure for allowing the cradle to be folded to a compact configuration.

In accordance with one aspect of the invention, there is provided a foldable cradle comprising a pair of frames pivotally coupled together at a pivot shaft, for allowing the frames to be rotated about the pivot shaft and to be rotated between an open position and a folded position, a first of the frames includes an upper portion having a beam, two rods secured to the beam and perpendicular to the beam, the rods each including two ends, a support, and means for securing the support to the ends of the rods.

The first frame includes an upper and middle portion having two pairs of ears for securing the pivot shaft, a second of the frames includes at least one positioning bar for engaging with the first frame and for maintaining the frames at the open position. The support is made of flexible weaving material.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
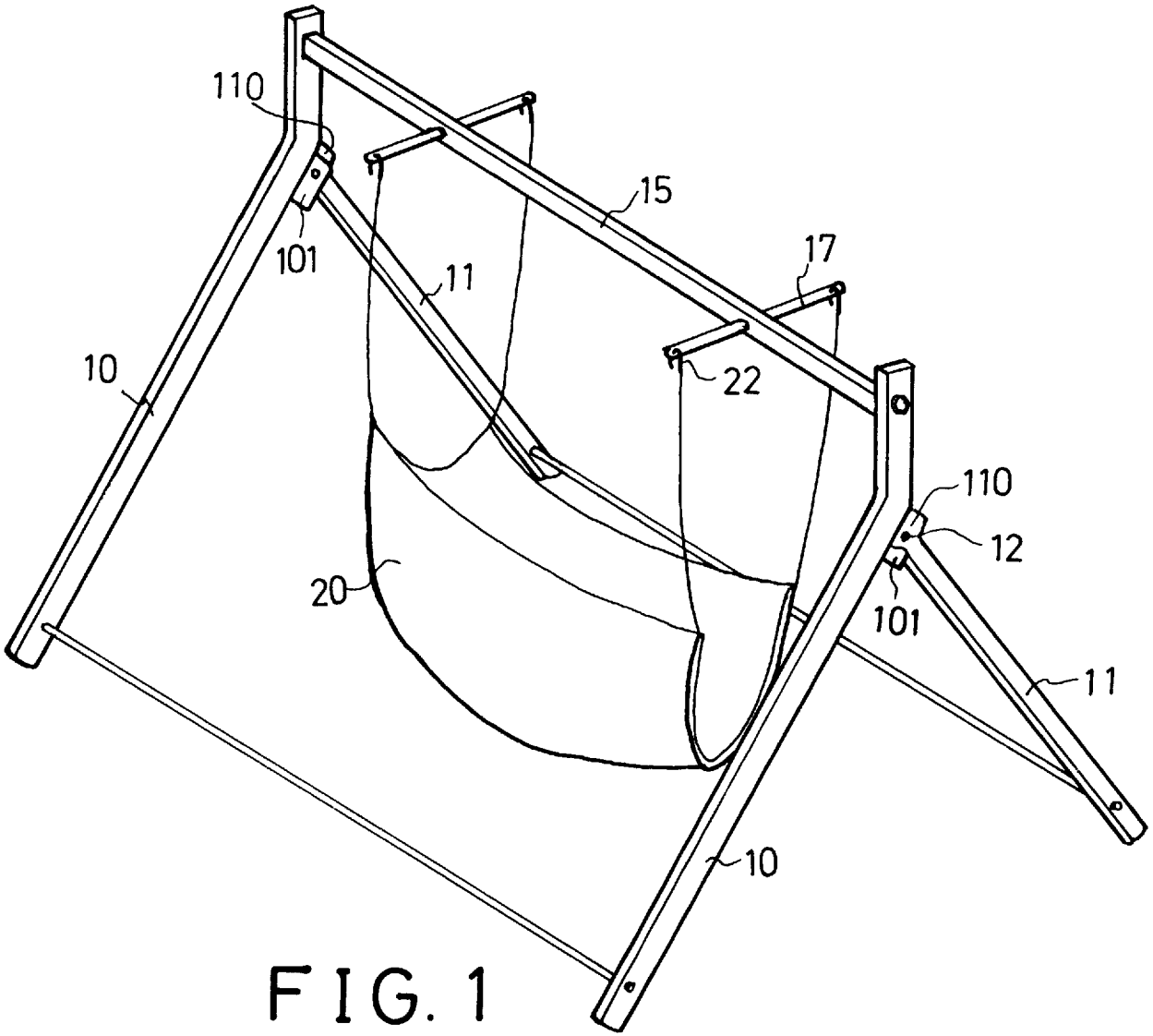
FIG. 1 is a perspective view of a foldable cradle.

Referring to the drawings, and initially to FIG. 1, a foldable cradle in accordance with the present invention comprises a pair of frames 10, 11 pivotally coupled together at a pivot shaft 12, for allowing the frames 10, 11 to be folded to a compact configuration and for allowing the frames 10, 11 to be opened to form a stable base. The frame 10 includes two pairs of ears 101 provided on the upper and middle portion for securing the pivot shafts 12. The frames 10, 11 include a rectangular shape. The frame 11 includes one or two positioning bars 110 for engaging with the frame 10 and for retaining the frames 10, 11 at an open position. The frame 10 includes a beam 15 and two rods 17 secured to the beam 15 and perpendicular to the beam 15. The rods 17 form a rectangular plane. A support 20 of flexible weaving material includes four corners each having a hook 22 or other engaging member for securing to the end portions of the rods 17 and for allowing the support 20 to be secured to the frame 10.

Figure 2:
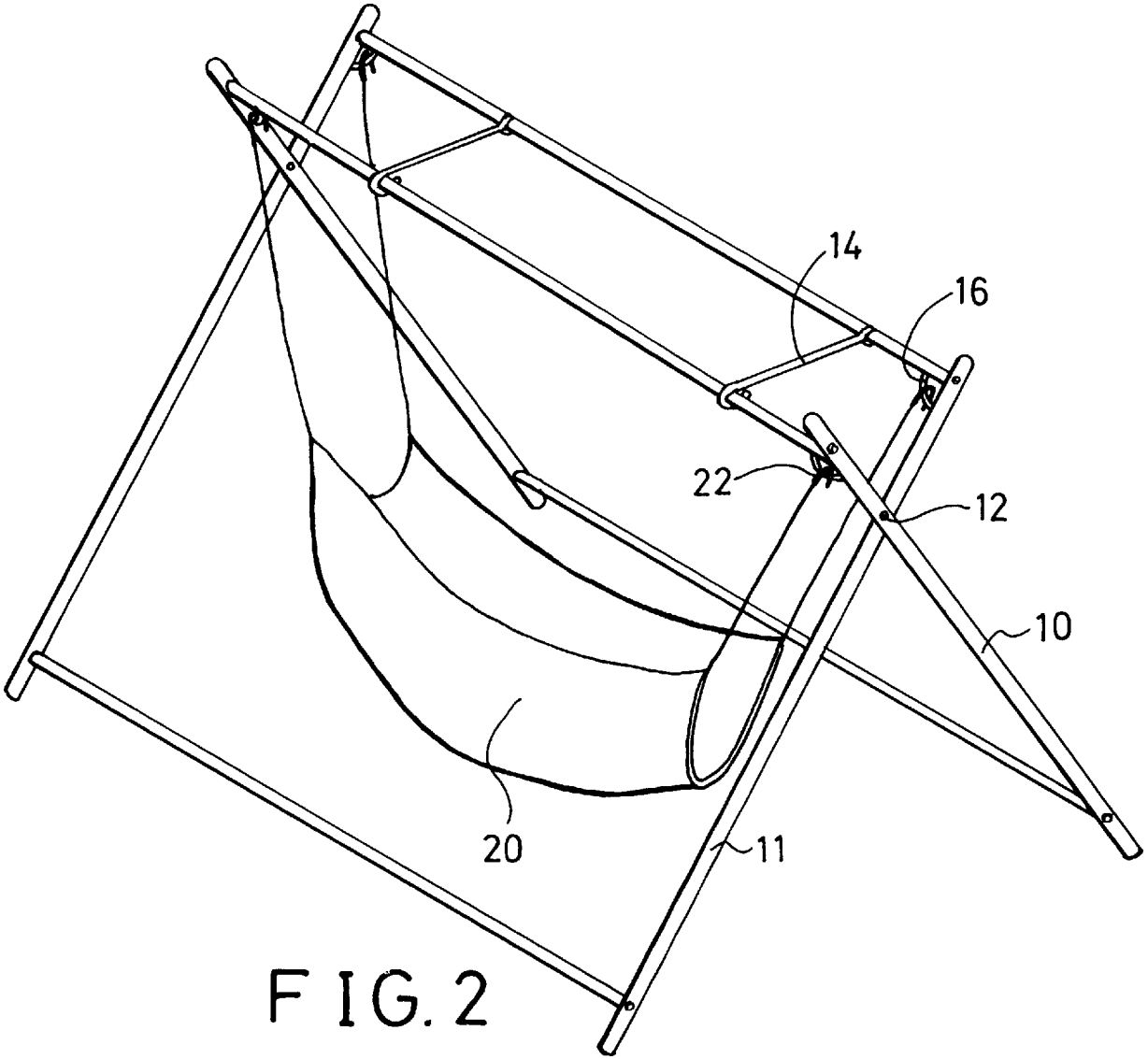
FIG. 2 is a perspective view showing another application of the foldable cradle.

As shown in FIG. 2, the frames 10, 11 include a middle or upper portion pivotally coupled together at the pivot shaft 12, for allowing the frames 10, 11 to be folded to a compact configuration. One or more positioning members 14, such as straps, wires etc., are secured between the upper portions of the frames 10, 11 for retaining the frames 10, 11 at an open position. The frames 10, 11 each includes two engaging members 16 formed in the upper side portions. The engaging members 22 of the support 20 may engage with the engaging members 16 for allowing the support 20 to be secured to the frames 10, 11.

The frames 10, 11 may be folded to a compact configuration which is excellent for storing and transportation purposes. In addition, the soft support 20 may comfortably support the baby. The parents may hold the baby directly by the support 20, when the baby fall asleep, without disengaging the support 20 from the baby, such that the baby will not be disturbed.

Accordingly, the cradle in accordance with the present invention includes a structure for allowing the cradle to be folded to a compact configuration and for allowing the parents to hold the baby without disturbing the baby when the baby fall asleep.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A foldable cradle comprising:

a pair of frames pivotally coupled together at a pivot shaft, for allowing said frames to be rotated about said pivot shaft and to be rotated between an open position and a folded position, a first of said frames includes an upper portion having a beam, said first frame including an upper and middle portion having two pairs of ears for securing said pivot shaft, a second of said frames including at least one positioning bar for engaging with said first frame and for maintaining said frames at said open position, two rods secured to said beam and perpendicular to said beam, said rods each including two ends, a support, and means for securing said support to said ends of said rods.

2. A foldable cradle according to claim 1, wherein said support is made of flexible woven material.

* * * * *